United States Patent [19]

Satoh et al.

[11] 4,276,626

[45] Jun. 30, 1981

[54] ELECTRONIC WATCH

[75] Inventors: Katsuhiko Satoh; Kazuhiro Asano; Masaaki Mandai; Makoto Ueda; Akira Torisawa; Masaharu Shida, all of Tokyo, Japan

[73] Assignee: Kabushiki Kaisha Daini Seikosha, Tokyo, Japan

[21] Appl. No.: 898,404

[22] Filed: Apr. 20, 1978

[30] Foreign Application Priority Data

Apr. 23, 1977 [JP] Japan ..... 52-47090

[51] Int. Cl.[3] ..... G04B 19/04; G04C 3/00

[52] U.S. Cl. ..... 368/80; 368/217

[58] Field of Search ..... 318/685, 696; 340/373, 340/636, 663, 672; 58/23 D, 23 R, 23 A, 23 BA, 152 H; 368/76, 80, 85–87, 217–219

[56] References Cited

U.S. PATENT DOCUMENTS

| | | | |
|---|---|---|---|
| 4,028,880 | 6/1977 | Ueda | 340/636 |
| 4,032,827 | 6/1977 | Debratz et al. | 368/159 |
| 4,114,364 | 9/1978 | Takahishi | 58/23 BA |
| 4,129,981 | 12/1978 | Nomoru | 58/23 BA |

*Primary Examiner*—Vit W. Miska

*Attorney, Agent, or Firm*—Robert E. Burns; Emmanuel J. Lobato; Bruce L. Adams

[57] ABSTRACT

In an electronic watch having an oscillator for producing a time base signal and stepping motor, drive pulses are produced for normally driving the motor under normal load conditions. The rotation and non-rotation of the motor in response to the last drive pulse is detected in response to a detecting pulse, and if non-rotation has been detected, a predetermined plurality of correction pulses are applied to the motor for driving same, the correction pulses being sufficient to drive the motor under a high torque loading. In this way, power consumption is decreased since a high power driving is saved only for high torque loading conditions.

5 Claims, 12 Drawing Figures

ELECTRONIC WATCH

BACKGROUND OF THE INVENTION

The present invention relates generally to improvements in electronic timepieces and more particularly to electronic timepieces having; means for reducing the power consumption of a stepping motor.

The present invention is best understood with reference to the prior art analogue type electronic wrist watch explained hereinafter.

The display mechanism of the conventional crystal watch of the analogue type now in use is constructed as shown in FIG. 1. The output of the timepiece motor comprised of a stator 1, a coil 7 and a rotor 6 is transmitted to different wheels 2, 3, 4 and 5 and a second hand, a minute hand, an hour hand as well as a calendar are driven by the wheels together with other wheels not shown.

The power consumption of a wrist watch is very small except for during a calendar switching operation, and a torque of 1.0 g-cm is sufficient for driving a second wheel in normal condition, while it is necessary to provide twice that torque for switching a calendar.

The time for switching a calendar is only six hours in twenty four hours, however a substantial amount of power for driving the watch movement is applied to the stepping motor during the calendar switching operation.

FIG. 2 shows a circuit construction of the conventional electronic watch. A signal of about 32 KHz, suitable for use as a time standard, is generated by an oscillating circuit 10 and is frequency-divided into a second signal by a frequency dividing circuit 11. The second signal is combined into the signal having either 7.8 msec or 2 sec period by a pulse combining circuit 12. To input terminals 15, 16 of drive inverters 13*a* and 13*b* is applied to a signal having the same pulse period and width but dephased by one second, so that an inverted pulse alternating every one second is applied to a coil 14. The rotor 6 magnetized in two poles begins to rotate in one direction. The coil current wave shape in this case is shown in FIG. 3.

In the meantime, the drive pulse width is the electronic watch according to the conventional art, i.e. 7.8 msec in the above mentioned embodiment, is designed in such a way that the factors such as coil resistance, number of turns, and size of the stepping motor are suitably selected so as to drive the stepping motor in a stable condition even when the load of the wheels weighs much, when the motor is placed in a magnetic field, when the internal resistance of the timepiece battery has been strikingly increased in a very low temperature, of when the battery voltage has been lowered because of exhaustion of the battery. Thus when a large torque is not necessary, this causes excess consumption of the battery.

SUMMARY OF THE INVENTION

The present invention aims to eliminate the above noted difficulty and insufficiency, and the object of the present invention is to provide an electronic timepiece in which a stepping motor is normally driven by pulses of shorter pulse widths than a conventional type, a stable or rotary condition of the rotor is detected by a voltage level across a resistor which is inserted in series with a coil after is applied a detection pulse and to a coil; a pulse signal of a wider pulse width is applied to the stepping motor when the rotor is in a stable condition whereby the rotation of the rotor is corrected.

DETAILED DESCRIPTION OF THE INVENTION

Figure 1:
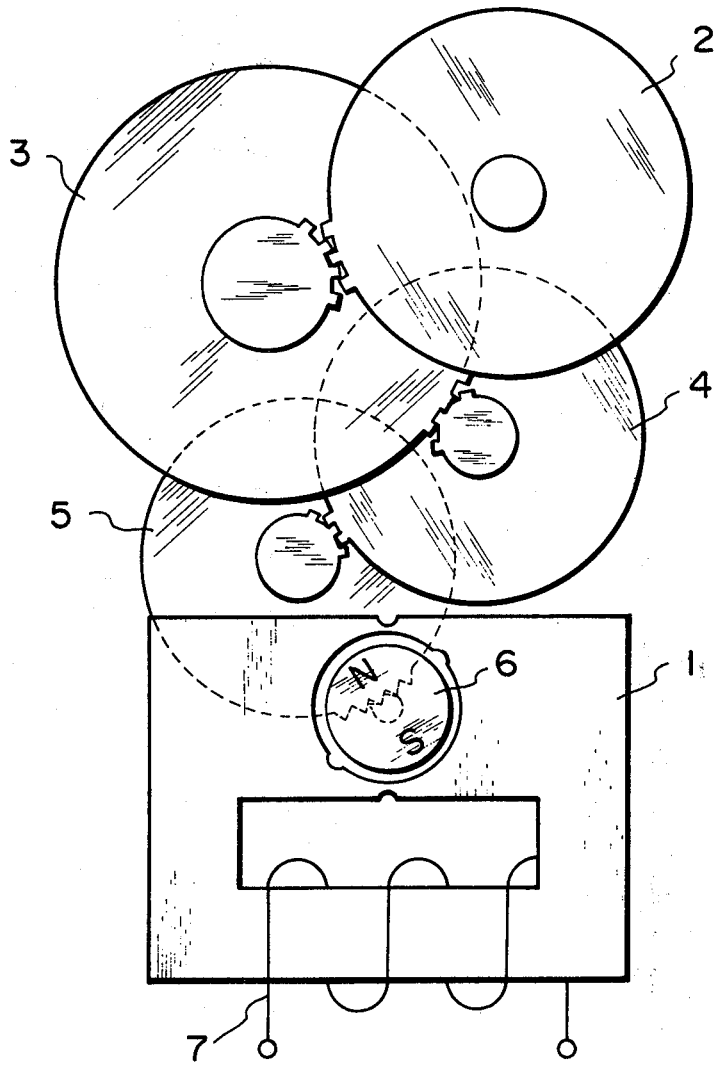
FIG. 1 PRIOR ART
FIG. 1 shows an explanatory flat view of a conventional quartz electronic timepiece.
Figure 2:
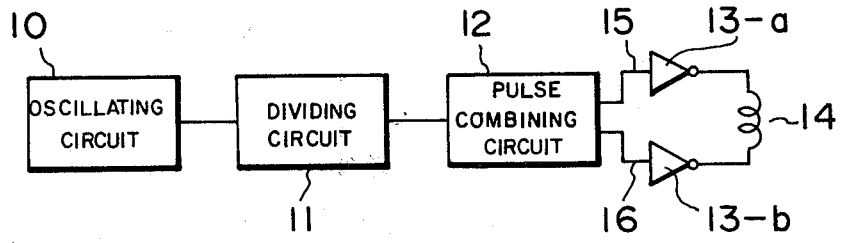
FIG. 2 PRIOR ART
FIG. 2 shows a block diagram of a conventional quartz electronic timepiece.
Figure 3:
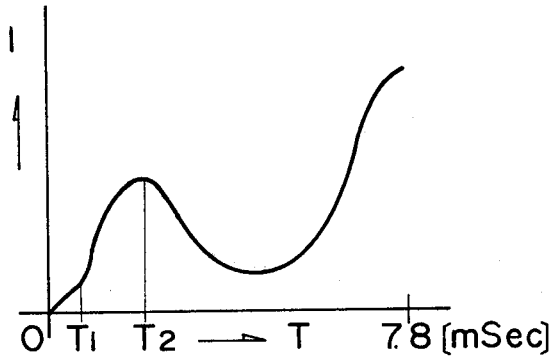
FIG. 3 PRIOR ART
FIG. 3 shows a current waveform of a stepping motor of a conventional quartz electronic timepiece.
Figure 4:
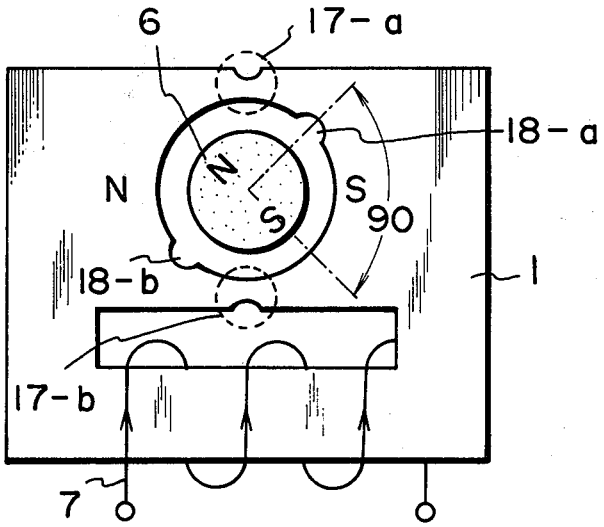
FIGS. 4, 5 and 6 show flat plan views for explaining the action of a stepping motor of the present invention.

The principle of the rotation of a stepping motor for use in the electronic watch according to the present invention is as follows;

Referring now to FIG. 4, numeral 1 shows a stator constructed in one integral body having a magnetic path or circuit 17 which is easily saturable. The stator is magnetically coupled to a magnetic core about which is wound the coil 7. In order to determine the direction of rotation of the rotor 6 which has two magnetic poles of opposite polarity provided in the direction of the diameter, a pair of notches 18*a*, 18*b* provided is the stator. In FIG. 4, the condition is shown in which electric current has just been applied to the coil 7. When no current is applied to the coil 7, the rotor 6 remains stationary at the position of approximately 90 degrees angle between the notches 18*a*, 18*b* and the magnetic poles of the rotor. In this condition, when, in the coil 7, the current flows in the direction of the arrow mark, the magnetic poles are produced in the stator 1 as shown in FIG. 4, so that the rotor 6 rotates in the clockwise direction by the poles repulsing each other. When the current flowing through the coil 7 is interrupted, the rotor 6 will station itself in the reversed condition of the magnetic poles with respect to the previous condition in FIG. 4. Afterwards, the rotor 6 keeps sequentially rotating in the clockwise direction by the current flowing in the opposite condition, further the rotor 6 sequentially rotates clockwise by reversing the direction of electric current which is applied to the coil 7. Since the stepping motor used in the electronic watch according to the present invention is constructed in one integral body having the saturable portions 17*a*, 17*b*, the current waveform flowing through the coil 7 presents a characteristics with the slow rising curve as shown in FIG. 3. The reason for this is that before the saturable portions 17*a*, 17*b* of the stator 1 become saturated, the magnetic resistance of the magnetic circuit seen from coil 7 is very small. Thus the time constant of the series circuit of the resistance and the coil becomes very large. The equation of this condition can be expressed as follows:

$$\tau = L/R,\ L \div N^2/Rm$$

Therefore, the following equation is established:

$$\tau = N^2/(R \times Rm)$$

Where L denotes the inductance of the coil 7, N is the number of turns of the coil 7, and Rm is the magnetic resistance.

When the saturable portions 17*a*, 17*b* of the stator 1 become saturated, the permeability of the portions becomes the same as that of the air. Accordingly, the Rm value increases and the time constant $\tau$ of the circuit becomes small and the wave of the current rises abruptly as shown in FIG. 3.

According to the present invention, the detection of the rotation or non rotation of the rotor 6 for use in an electronic wrist watch is described at the difference of the time constant of the circuit consisting of the resistor and coil connected in series. The reason for producing the difference of the time constants will now be explained hereinafter.

Figure 5:
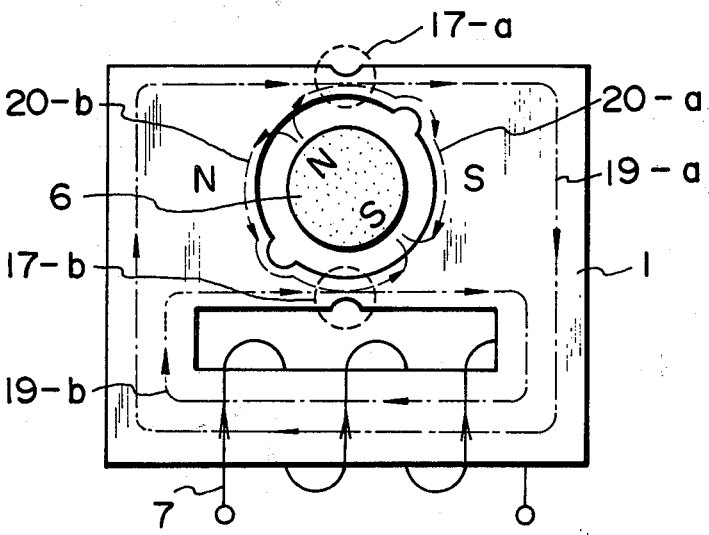

FIG. 5 shows a magnetic field at the time of flow of the current through the coil. In the figure, the rotor 6 is in the position in which it is rotatable against the magnetic poles. The magnetic flux 20 is the one which is derived from the rotor 6. The magnetic flux which intersects the coil 7 also exists practically, however, this is neglected in this case. The magnetic fluxes 20*a* and 20*b* are shown as being derived from the saturable portions 17*a* and 17*b* of the stator 1 and they are directed by the arrow mark. The saturable portions 17*a*, *17b* are, in the most cases, not in the saturated condition at this time. In this condition, the current is flowing in the direction of the arrow mark of the coil 7 so as to rotate the rotor 6 clockwise. The magnetic fluxes 19*a* and 19*b* produced by the coil 7 are added to the magnetic fluxes 20*a* and 20*b* produced by the rotor 6 within the saturable portions 17*a* and 17*b*, so that the portions 17*a*, 17*b* of the stator 1 rapidly saturates.

Figure 7:
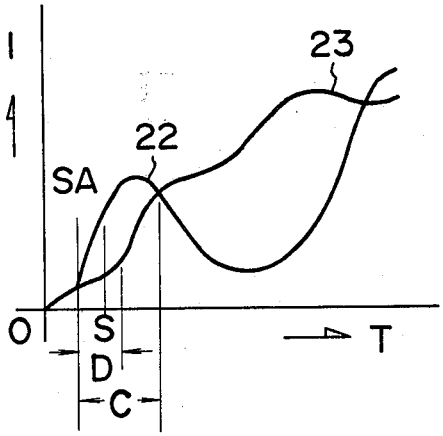
FIG. 7 shows current waveforms of a rotor which is in the stopped condition of rotated condition.

Afterwards, the magnetic flux which is sufficient for rotating the rotor 6 is produced. However this is omitted in FIG. 5. FIG. 7 shows the waveform of the current flowing through the coil as numeral 22.

Figure 6:
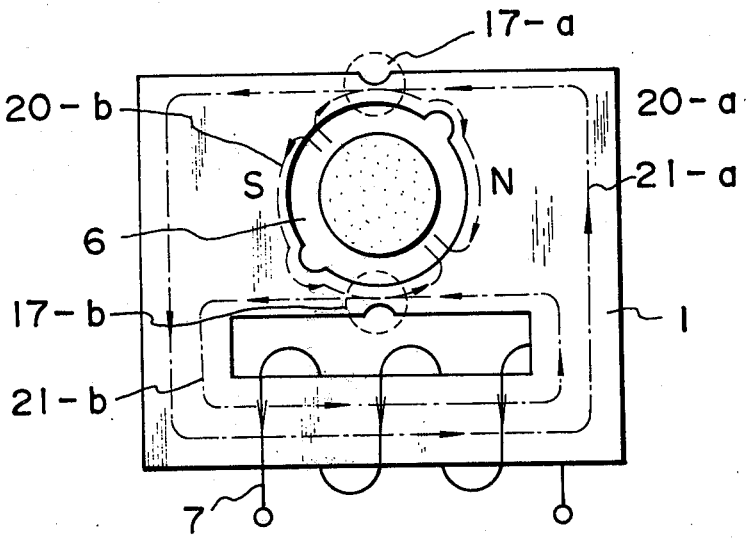

FIG. 6 shows the condition of the magnetic flux in which the current is flowing through the coil 7 at the time when the rotor 6 could not be rotated for some reasons and returned to the original point. Generally, in order to rotate the rotor 6, the current must be flowing in the coil 7 in the opposite direction against the arrow, i.e. in the same direction as that as shown in FIG. 5. However, in this case since an alternating inverted current is applied to the coil 7 for every rotation, this condition occurs whenever the rotor 6 could not be rotated. Since the rotor 6 could not be rotated in this case, the direction of the magnetic flux produced from the rotor 6 is the same as the one shown in FIG. 5. In this case, since the current is flowing in the opposite direction with respect to FIG. 5, the direction of the magnetic fluxes become 21*a* and 21*b*. In the saturable portions 17*a* and 17*b*, the magnetic fluxes produced respectively from rotor 6 and the coil 7 cancel each other, so that in order to saturate these portions of the stator 1, a longer time is required. FIG. 7 shows this condition as numeral 23. In this embodiment, the time interval "D" before the portions 17*a*, 17*b* of the stator 1 saturate in FIG. 7, was 1 msec. On the condition that the diameter of the coil is 0.23, the number of turns 10000, the coil series resistance 3 kΩ, the diameter of the rotor 1.3 and the minimum width of the saturable portion 0.1.

As it is apparent from the waveforms 22 and 23 of the two currents in FIG. 7, the inductance of the coil is small when the rotor 6 is rotating within the range of C in FIG. 7 while it is large at the time of non-rotation. In the stepping motor as described above, the equivalent inductance in the range of "D" was chosen as L=5 henry at the current waveform of 22 when rotating, and was chosen as L=40 henry at the waveform 23 during non-rotation. For instance, when the resistor "r" as a passive element for the detection and the coil series resistor "R" are connected in series to the inductance through the power supply VD, the change in inductance is easily detected by the voltage appearing across the resistor element for the detection in detecting the threshold value Vth of the MOS inverter, i.e. ½ Vn voltage. From the fact that the voltage produced across the resistor r is ½ Vn, the following equation is obtained.

$$(\tfrac{1}{2})\cdot VD = r/(R+r)\cdot[1-\mathrm{Exp}\{-(R+r)\cdot t/L\}]$$

In this equation, when R=5 KΩ, t=1 msec, L=4 henry, then r becomes 29 KΩ. Moreover, in the case of the current waveform 22 in FIG. 7, the saturation time is approximately 0.4 msec. Therefore, calculating the equation with R=3 KΩ, t=0.4 msec, L=5 henry, the resistor r is 7.1 KΩ. This means that the detectable range of the detecting resistor element falls between 7.1 KΩ to 29 KΩ. This result coincides with the result of experimentation. In the embodiment according to the present invention, the resistor element is used as a detecting element. However, it is also possible for the element to be constructed from a passive element such as coil, capacitor or with an active element such as a MOS transistor.

As it is apparent from the above description, rotation or non-rotation of the rotor 6 is to be determined by applying a detection signal so that one is able to drive the rotor in a low torque condition by applying a pulse with a short width as well as to amend the driving in high torque condition by a in pulse with a long width for non-rotation of the motor.

Figure 8:
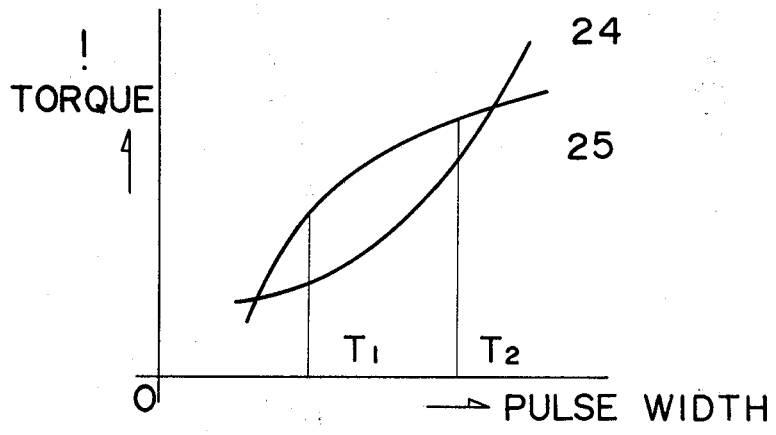
FIG. 8 shows a graph of a relation of current consumption, output torque and drive pulse width.

The determination of both pulses with a short width and a long width can be determined from the pulse width and current torque curve shown in FIG. 8. The pulse with a short width $t_1$ is set by the minimum torque necessary for normal pendulum movement and the specification of the motor is determined so as to obtain a maximum efficiency with this pulse width as well as to reduce the current consumption as much as possible. The pulse with a long width $t_2$ for the corrective driving is the width $t_2$ which enables one to obtain the maximum torque to be guaranted as a wrist watch. From the foregoing it is possible to obtain an electronic wrist watch with very low power consumption compared with the conventional ones by setting the pulse widths $t_1$ and $t_2$ as described above.

Furthermore, the feature of the detecting portion of the electronic watch according to the present invention resides in enabling the detection of inductance change without using another specific amplifier. In FIG. 7, there is shown a very simple method for realizing the detection in which a D.C. resistor of the value of which is nearly the same as that of the coil 7 or larger than that is temporally inserted in series to the coil 7 so as to apply a voltage across the resistor which is decided by the voltage dividing ratio of the impedance of the coil 7 and the resistor.

Figure 9:
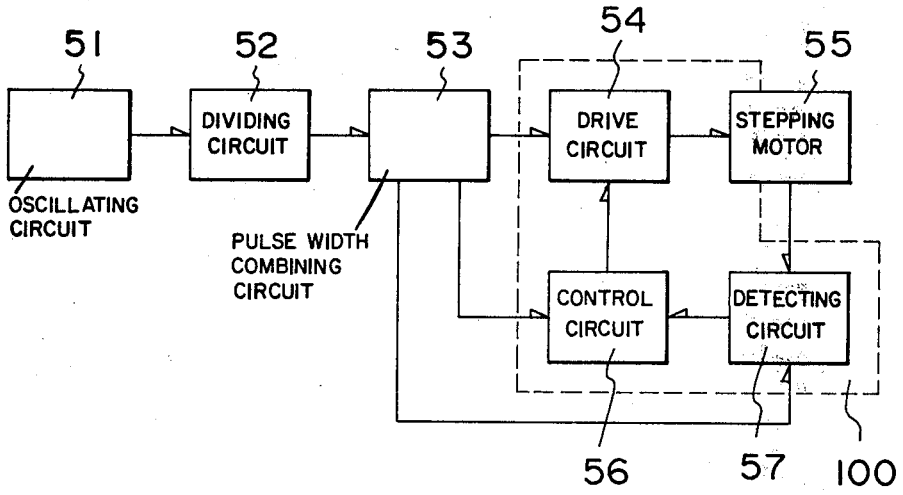
FIG. 9 shows a circuit block diagram of an electronic timepiece of the present invention.

FIG. 9 shows the block diagram of an overall electronic watch. A crystal oscillating, circuit 51 oscillates to produce a signal which is used as a time standard signal of the watch. A frequency dividing circuit 52 constructed by multi-stage flipflops frequency-divides the oscillating signal to a one second signal. A pulse width combining circuit 53 combines from each flipflop output of the frequency dividing circuit, a normal drive pulse signal with the pulse width necessary for the normal driving, a correction drive pulse signal for the correcting drive, a detection pulse signal with a duration necessary for the detection, a time interval setting signal between the normal drive pulse and the detecting pulse, and a time interval setting signal between the detection pulse and the correction drive pulse etc.

A drive circuit 54 supplies the normal drive pulse, the detecting pulse, or the correction drive pulse as an inverted pulse to the stepping motor.

The rotor of the stepping motor 55 is rotated by the application of the normal drive pulse when the load is low. However, the rotor is not rotated when the load is high, so that it is possible to detect either the rotating condition or the non-rotating condition of the rotor from the difference of the coil depending on the above condition by applying the detection signal to the detection circuit 54. Accordingly, when the load of the motor increases for some reason and the rotor is not rotated at the time of applying the normal drive pulse, either the rotating or non-rotating condition of the rotor is detected by applying the detection pulse immediately after the drive pulse has been applied. In this case, when the rotor is not rotated, the correction drive pulse with a broader pulse width is applied to the rotor from the control circuit 56 for the corrective driving. In the embodiment of the electronic watch according to the present invention, the direction of the detection pulse is set in the same direction as that of the drive pulse, but it is also possible for the direction of the drive pulse to reverse.

Figure 10:
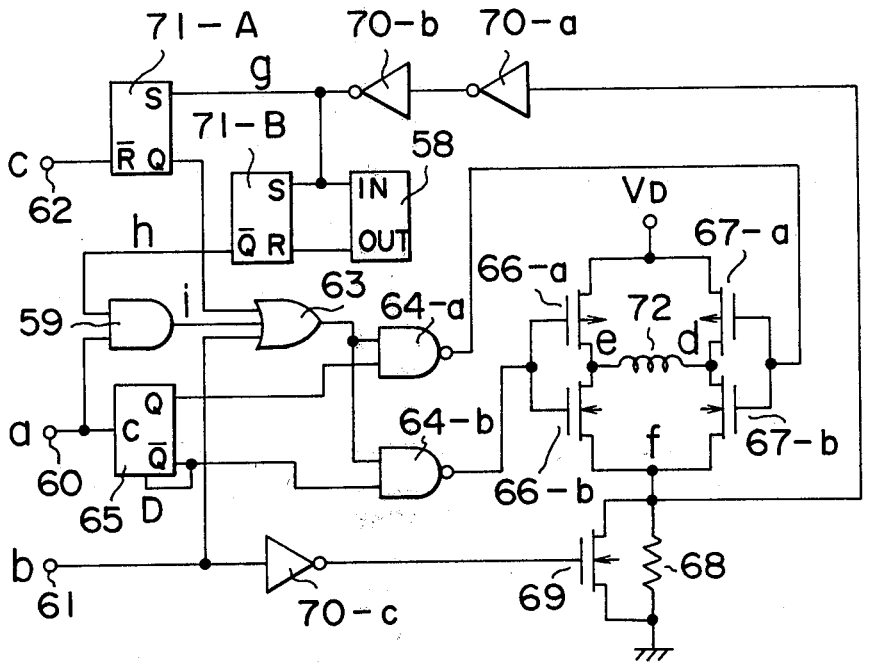
FIG. 10 shows a circuit construction of a motor control circuit.

In the present embodiment, the pulse width combining circuit 53 can be easily constructed by the direct use of the pulses, such as 1 msec, 3.9 msec, 7.8 msec and 31 msec which are obtainable from the output of the crystal oscillating circuit 51 oscillating at 32,768 KHz by dividing the same. A detailed circuit thereof is, therefore, omitted. FIG. 10 shows an embodiment of the motor control circuit 100. The drive circuit 54 consists of NAND gates 64*a* and 64*b*, a flip-flop 65, and driving inverters 66*a*, 66*b* and 67*a*, 67*b*. The motor 55 is provided with the coil 72. The detecting circuit 57 comprises inverters 70*a*, 70*b* and 70*c*, a transistor 69 as a switching element and a resistor element 68. The control circuit 56 is constructed by flipflops 71A, 71B, OR-gate 63, N-counting counter 58 and AND-gate 59, with an inhibit input prevention circuit disposed in said flipflop 71B, not indicated in a drawing, where an output "h" becomes high level when an inhibit is applied thereinto.

Figure 11:
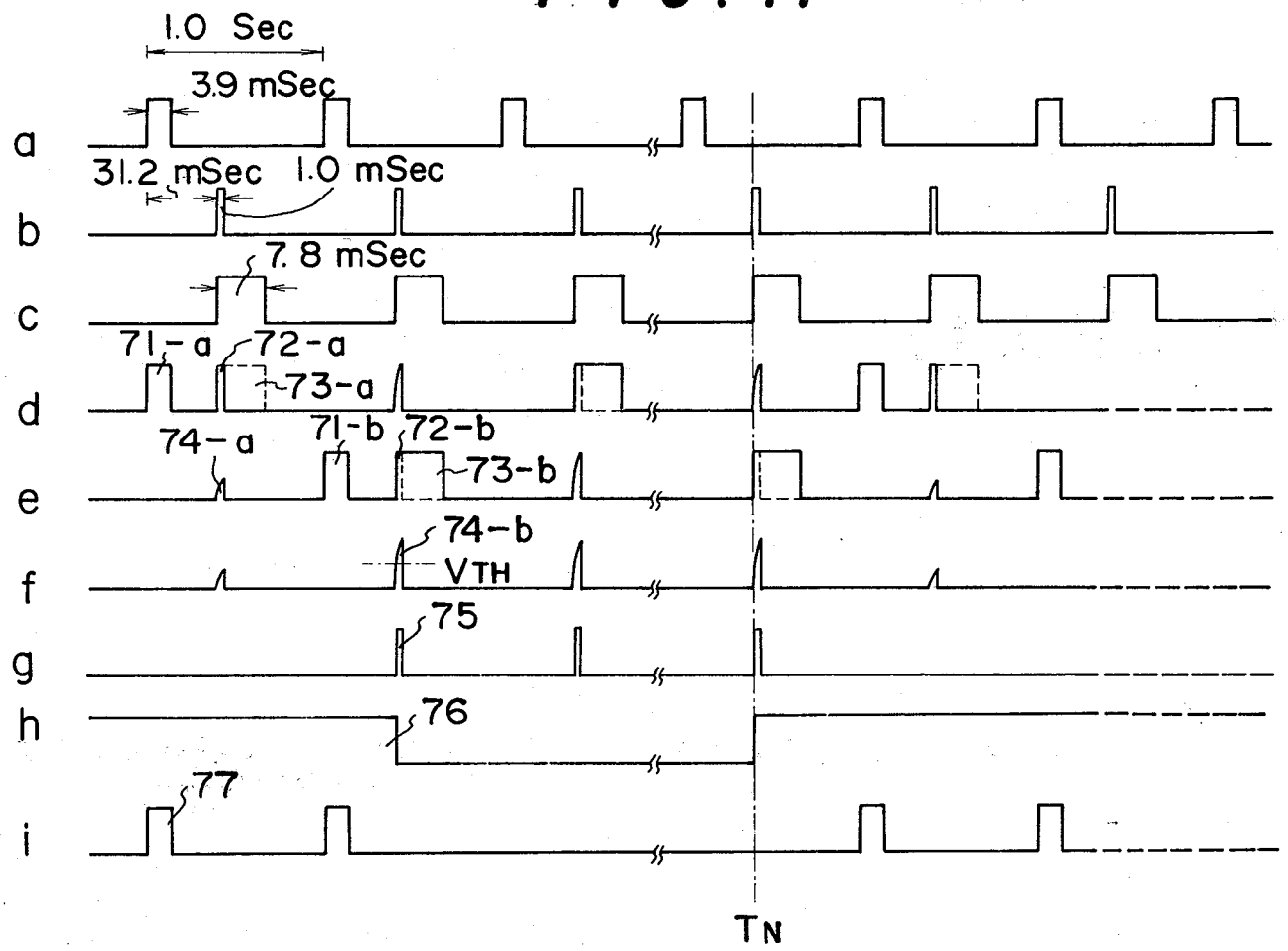
FIG. 11 shows a time chart of the points in said FIG. 10.

FIG. 11 shows a timing chart of each portion (a, b, c, d, e, f, g, h and i) of FIG. 10. A normal drive pulse of 3.9 msec, a detection pulse of 1.0 msec and a correction drive pulse as indicated in FIG. 11 are applied to the terminals 60, 61 and 62 in FIG. 10. These signals are combined by AND-gate 59 and OR-gate 63 and also the phases thereof are selected by flipflop 65 and NAND gates 64*a* and 64*b*. These signals are applied to the terminal of the coil 72 through the drive inverters 66*a*, 66*b* and 67*a*, 67*b* as e and d shown in FIG. 11. On the other hand, inverters 70*a*, 70*b* and 70*c*, transistor 69 and resistor 68 detect a rotation or non-rotation of the rotor by the detection pulse, an output signal of the detection circuit is applied to a flipflops 71A and 71B and N-counting counter 58, and controls the correction pulse, and is transferred to the AND-gate 59 and OR-gate 63 as a feedback control signal.

Figure 12:
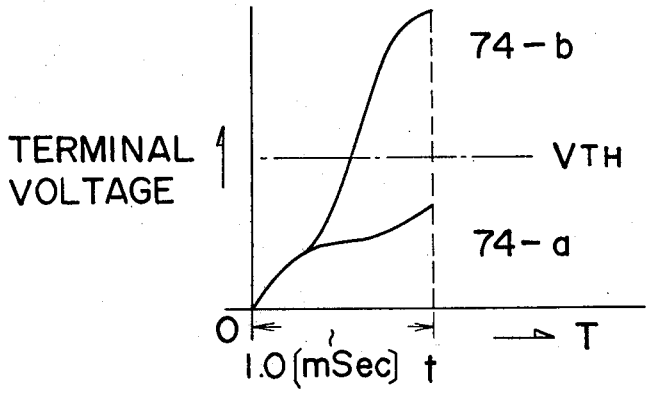
FIG. 12 shows a waveform which appears at the terminal of the resistor element.

Referring now to the operation of the present invention, when a normal drive pulse a is applied to a terminal 60, a normal drive pulse 71*a* as indicated in the drawing is applied to a coil terminal "d" whereby the rotor 6 is normally rotated in one step (at this time, "h" is high level). Further when a detection pulse 72*a* is applied to a coil terminal "d", a magnetic pole of the rotor 6 and a magnetic pole of the stator 1 reach the condition as indicated in FIG. 6. At this time, a starting condition of a current waveform of the coil 72 or coil 7 is slow, it is very similar to a starting condition of "23" in FIG. 7. Further at this time, the transistor 69 is in the OFF-state whereby a coil 72 is connected to resistor 68 in series, a detection voltage "Vr" which appears in the terminal f of the resistor 68 a becomes value proportional to the current of the coil 72. In this width of a detection pulse of t=1.0 msec, it is impossible to attain a threshold value Vth of inverter 70*a* as indicated in "74*a*" of FIGS. 11 and 12.

Accordingly, the level of input signal of a set terminal "S" of flipflop 71A is not changed, and is maintained at a low level, whereby a correction drive pulse is not generated. At this time, the level of input signal of the N-counting counter 58 is at a low level, similarly the level of the input signal of a set terminal "S" of flipflop 71B is at a low level, whereby the output "h" of flipflop 71B is maintained at a high level.

For example, in the case wherein the rotor 6 is not rotated in spite of applying a normal drive pulse 71*b* to a coil terminal "e" and further a detection pulse 72*b* is applied to the coil terminal, a magnetic pole of the rotor 6 and a magnetic pole of the stator 1 go into the condition indicated in FIG. 5, a waveform of a current of the coil 72 has the quick starting condition which is different from a rotor 6 which is normally rotated, whereby it shows a condition which is similar to a starting condition of 7 in FIG. 22. Further, according to an action of the transistor 69, a detection voltage "Vr" is applied to a terminal "f" of the resistor 68. The detection voltage "Vr" overcomes a threshold value "Vth" of the inverter 70*a* as indicated in "74*b*" of FIGS. 11 and 12, an output of the inverter "70*a*" is formed by the inverter 70*b*, whereby a pulse signal 75 appears at an output "g" of the inverter 70*b*. The level of the input signal of a set terminal "S" of the flipflop 71A is changed from low to high by pulse signal 75, and at this time, a correction drive pulse is applied to a terminal 2, whereby a correction drive pulse 73*b* is applied to the coil terminal "e" via OR-gate 63, flipflop 65, NAND-gates 64*a* and 64*b* and inverters for the stepping motor 66*a*, 66*b* and 67*a*, 67*b*, therefore the rotor 6 is normally rotated. N-counting counter 58 counts one pulse, and the output of the counter 58 is maintained at a low level until counting N-counts. On the other hand, when an input signal of a high level is applied to the set terminal "S" of the flipflop 71B, for a value of "N" of N-counting counter 58 more than "2", the input signal of reset terminal "R" of the flipflop 71B is maintained at a "low level". Further when an input signal of high level is applied to a set terminal "S" of the flipflop 71B, the output Q of the flipflop 71B is changed from high level to low level, and the output signal of low level is applied to AND-gate 59 as an input signal, whereby an output "i" of AND-gate 59 is always maintained in low level until the output Q of flipflop 71B goes to the high level, even if an input signal of high level is applied to a terminal 60. Namely, a normal drive pulse is not applied to the coil terminals "d" and "e" until a value of "N" of N-counting counter 58 attains N-counts, and until an input signal of high level is applied to a reset terminal "R" of the flipflop 71B, and until an output "h" is changed to the "high" level. A detection pulse "Vr" which is same as 74*b* is always detected to terminal "f" of the resistor element 68 by a detection pulse since a normal drive pulse is not applied to the coil terminal "d" and "e", the rotor 6 is continuously rotated by applying a correction drive pulse to the coil terminals "d" and "e" only during N-counts of said N-counting counter 58. When a value of "N" of the N-counting counter 58 is accomplished to N-counts, an input signal of AND-gate 59 is changed from low level to high level and is maintained. Further when a normal drive pulse is applied to the terminal 60, the normal drive pulse is applied to the coil terminals "d" and "e", after that, the operation is repeated by detecting the rotation and non-rotation condition of the rotor 6 according to the detection pulse.

Referring now to experimental data according to the embodiment of the present invention, in conventional type of watch motor having a drive pulse width 7.8 msec, an average current consumption of a stepping motor is about 1.5 $\mu$A (calendar type). In the present invention type having a normal drive pulse width 2.9 msec and a correction drive pulse width 7.8 msec, an average consumption current of a stepping motor is about 0.69 $\mu$A (calendar type). Thereby its consumption current becomes about 4.6% of the conventional type, and it is able to attain remarkable reduction of a power consumption.

According to the present invention, a detection pulse is applied to a coil, whereby rotation or non-rotation of the rotor is discriminated by a current characteristic or a voltage signal, whereby it is able to detect rotation or non-rotation without modification of the stepping motor. Therefore, a drive pulse width of the stepping motor is set at a width in which the stepping motor is not stopped under the full range of normal load conditions. For example, when a worst case condition for the timepiece exists, the stepping motor is correctively driven by a correction drive pulse after detecting a non-rotation signal of the rotor. Therefore, in the above noted worst case condition, the stepping motor is not stopped, further an average power consumption is added as a small detection power and a correction drive power which is generated in a normal drive and calendar switching condition, and it is able to reduce consumption power.

In the case of detecting a saturation time difference of a supersaturated portion of the stator which is of the one-piece type, a circuit of an electronic timepiece is composed of switching elements of transistors, a part except for the switching elements is only one resistor element, resistance value of said resistor element in the range from 7.1 K$\Omega$ to 29 K$\Omega$, it is able to mount the resistor element into an integrated circuit, whereby all of elements are mounted into the integrated circuit. Therefore, it is not necessary to provide external parts for controlling the pulse width, whereby a lower cost is easily attained. Further one is able to correct an irregularity of the resistor value in the production process of the integrated circuit and to use other stepping motors of different types by mounting an intermediate terminal to the resistor element in the integrated circuit and selecting a resistor value of the resistor element and mounting a pad to the integrated circuit. In case of employing an active element as a detection element, all of the circuits are constructed in the form of an integrated circuit. A threshold voltage Vth is always a half of the power source by employing C-MOS logic element as a binary logic element for constructing a detection circuit, whereby one is able to construct a detection circuit which is not affected by the irregularity of the voltage of the power source, whereby all of the circuits are constructed by C-MOS. Further one can utilize an electronic timepiece having a stepping motor in which a coil has a difference of inductance in rotation or non-rotation of the rotor without connection of types of a stepping motor.

We claim:

1. An electronic timepiece comprising: a stepping motor; an oscillating circuit for producing a time standard signal; a dividing circuit for frequency-dividing the time standard signal; a pulse combining circuit for combining the frequency-divided signals to produce normal drive pulses and correction drive pulses; a drive circuit for applying drive pulses to the stepping motor to effect driving of the stepping motor with the drive pulses; a detection circuit for detecting a rotation or non-rotation condition of the motor in response to the normal drive pulse after the application of the normal drive pulse; and means for controlling said drive circuit to apply a predetermined plurality of correction drive pulses to the motor instead of the normal drive pulses after the detection of a non-rotation condition.

2. An electronic timepiece according to claim 1; wherein said detection circuit comprises a resistor connected to said drive circuit, and a switching element connected to said resistor.

3. In an electronic timepiece having an oscillator for producing a time base signal and a stepping motor rotationally driven in a stepwise manner by drive pulses applied thereto: means receptive of the time base signal for producing therefrom normal drive pulses each having a pulse width sufficient to drive the motor under normal load and insufficient to drive the motor under worst case load and for producing therefrom correction drive pulses each having a pulse width sufficient to drive the motor under worst case load; controllable driving means connected to receive the normal and correction drive pulses for applying corresponding drive pulses to the motor to effect stepwise driving of the motor; detecting means for detecting the rotation and non-rotation of the motor after the application of each normal drive pulse; and control means responsive to the detection of non-rotation of the motor by the detecting means for controlling the driving means so that a predetermined plurality of correction drive pulses instead of normal drive pulses are applied to the motor for driving the same.

4. An electronic timepiece according to claim 3; wherein the control means comprises two control flip-flops settable in response to detection of non-rotation of the motor, an N-counting counter startable in response to such detection and developing an output for resetting one control flip-flop when the count thereof reaches N wherein $N>1$, and means receptive of the outputs of the control flip-flops for controlling the driving means so that N correction drive pulses are applied to the motor.

5. An electronic timepiece according to claim 3; wherein the detecting means comprises a resistor connected to the driving means, and a switching element connected to said resistor.

* * * * *